US005934706A

United States Patent [19]

Yiu

[11] Patent Number: 5,934,706

[45] Date of Patent: Aug. 10, 1999

[54] SKATE DEVICE HAVING MAGNETIC SUPPORT

[76] Inventor: Chih-Hao Yiu, 7f-1, No.30, Lins Sen Road, Taichung, Taiwan

[21] Appl. No.: 08/937,498

[22] Filed: Sep. 25, 1997

[51] Int. Cl.[6] ..... A63C 1/00

[52] U.S. Cl. ..... 280/844; 280/11.26

[58] Field of Search ..... 280/844, 11.22, 280/842, 11.19, 11.26, 11.28; 198/690.1; 180/9.1

[56] References Cited

U.S. PATENT DOCUMENTS

| | | | |
|---|---|---|---|
| 1,694,162 | 8/1928 | Buitenkamp | 280/844 |
| 3,512,602 | 5/1970 | Bertelsen | 180/9.1 |
| 3,671,051 | 6/1972 | Werft | 280/844 |
| 4,842,086 | 6/1989 | Michna | 180/9.1 |
| 5,390,958 | 2/1995 | Soo | 280/844 |
| 5,580,096 | 12/1996 | Freilich | 280/844 |

*Primary Examiner*—J. J. Swann
*Assistant Examiner*—James S. McClellan
*Attorney, Agent, or Firm*—Charles E. Baxley, Esq.

[57] ABSTRACT

A skate device includes a number of magnetic members engaged on an outer peripheral portion of a frame and includes a flexible belt engaged around the frame. A number of magnetic members are secured in the belt for acting with the magnetic members of the frame and for spacing the belt from the frame and for allowing the belt to move around the frame without friction and for allowing the skate device to be operated on soft and uneven surfaces. The frame includes two frame members separated from each other and coupled together by a bolt for adjusting the two frame members away from and toward each other. A number of pads are engaged on the outer peripheral portion of the belt for forming a wheel device for the skate device.

7 Claims, 5 Drawing Sheets

SKATE DEVICE HAVING MAGNETIC SUPPORT

BACKGROUND OF THE INVENTION

1. Field of the Invention

The present invention relates to a skate, and more particularly to a skate device having magnetic support.

2. Description of the Prior Art

Typical skates comprise two or more wheels secured to a frame for allowing the frame and the skates to be moved on hard and flat surfaces. However, the skates may not be operated on soft and uneven surfaces. For example, the skates may not be operated on sand due to high frictional force.

The present invention has arisen to mitigate and/or obviate the afore-described disadvantages of the conventional skates.

SUMMARY OF THE INVENTION

The primary objective of the present invention is to provide a skate device having magnetic support for allowing the skates to be operated on soft and uneven surfaces.

In accordance with one aspect of the invention, there is provided a skate device comprising a frame including an outer peripheral portion, a first magnetic member engaged on the outer peripheral portion of the frame, a flexible belt engaged around the frame, and a plurality of second magnetic members secured in the belt for acting with the first magnetic member and for spacing the belt from the frame and for allowing the belt to move around the frame with minimal friction.

The frame includes a flat upper portion and a flat bottom portion and two curved end portions. The frame includes two frame members separated from each other, and a bolt coupled between the two frame members for coupling the frame members together and for adjusting the two frame members away from and toward each other. The frame includes a cushioning member engaged between the first magnetic member and the frame for absorbing shocks and vibrations transmitted to the frame. The first magnetic member includes a plurality of magnetic segments.

The frame includes a pair of walls extended radially outward for forming an annular chamber and for receiving the belt, the walls each includes a third magnetic member, the skate device includes a plurality of casings secured to the belt and spaced from each other, the casings each includes a middle bracket for securing the second magnetic members and each includes two side brackets and each includes two fourth magnetic members engaged in the side brackets for acting with the third magnetic members and for retaining the belt in the annular chamber of the frame. The frame includes a first permeance member engaged between the frame and the first magnetic member, and includes a second permeance member engaged between the belt and the second magnetic member, and includes a third permeance member engaged between the walls of the frame and the third magnetic member, and includes a fourth permeance member engaged between the side brackets of the casing and the fourth magnetic member for confining magnetic current and magnetic field within the frame.

The belt includes an outer peripheral portion and includes a plurality of pads secured to the outer peripheral portion of the belt for allowing the pads to move around the frame and for allowing the pads to form a wheel device for the skate device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
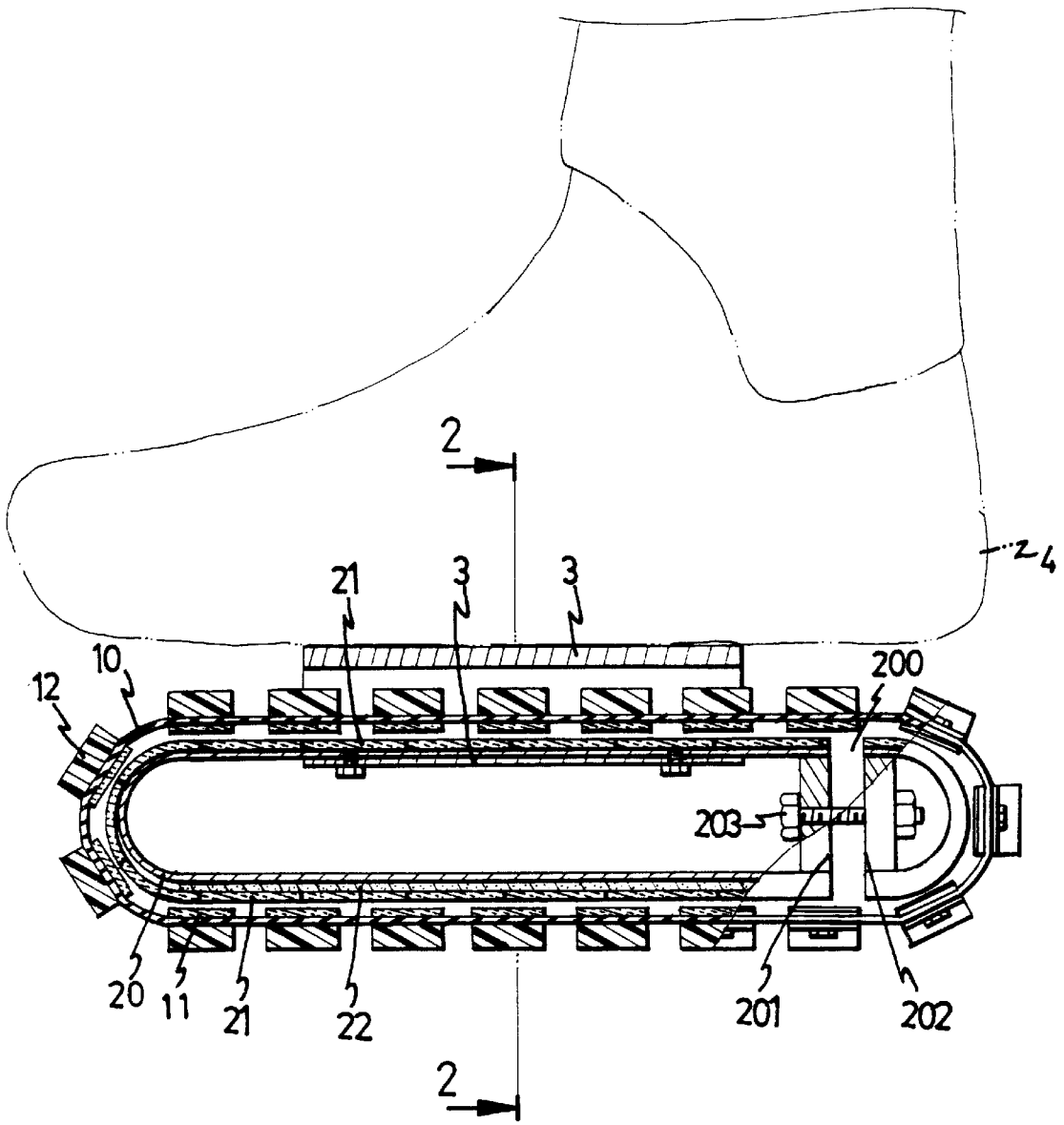
FIG. 1 is a cross sectional view of a skate device in accordance with the present invention, taken along lines 1—1 of FIG. 2.
Figure 2:
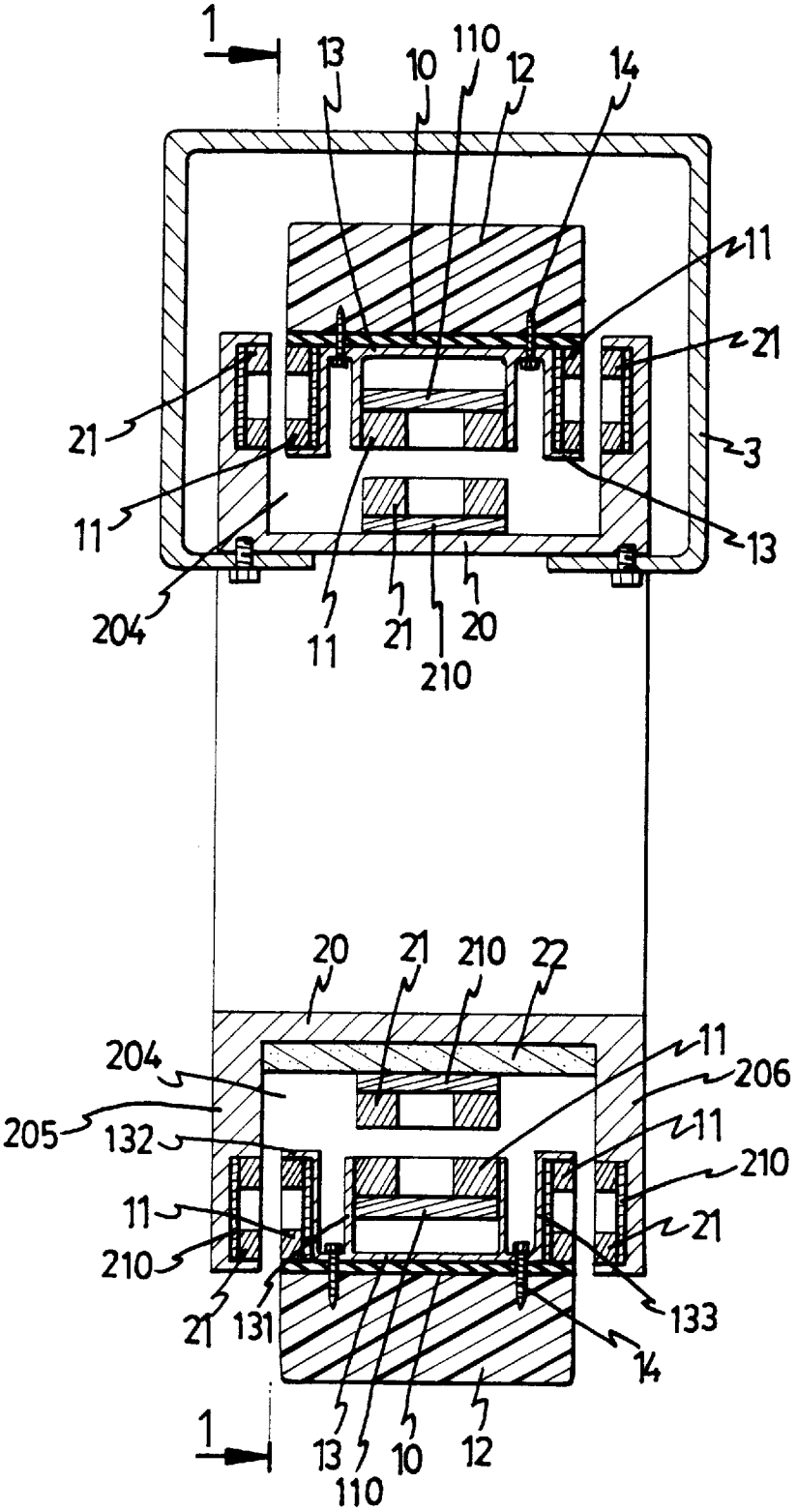
FIG. 2 is a cross sectional view taken along lines 2—2 of FIG. 1.
Figure 3:
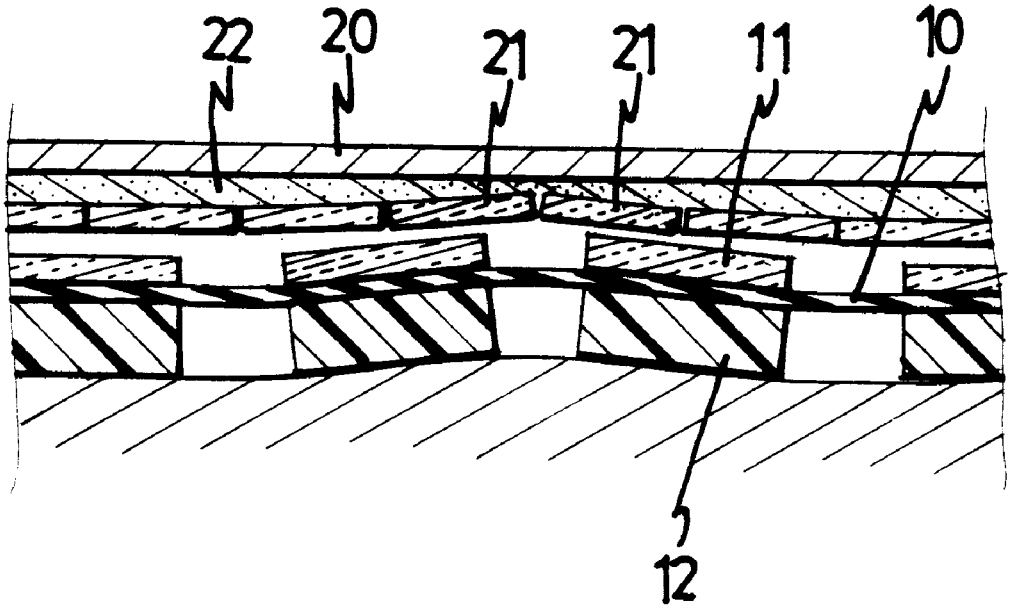
FIG. 3 is an enlarged partial cross sectional view, illustrating the operation of the skate device.
Figure 4:
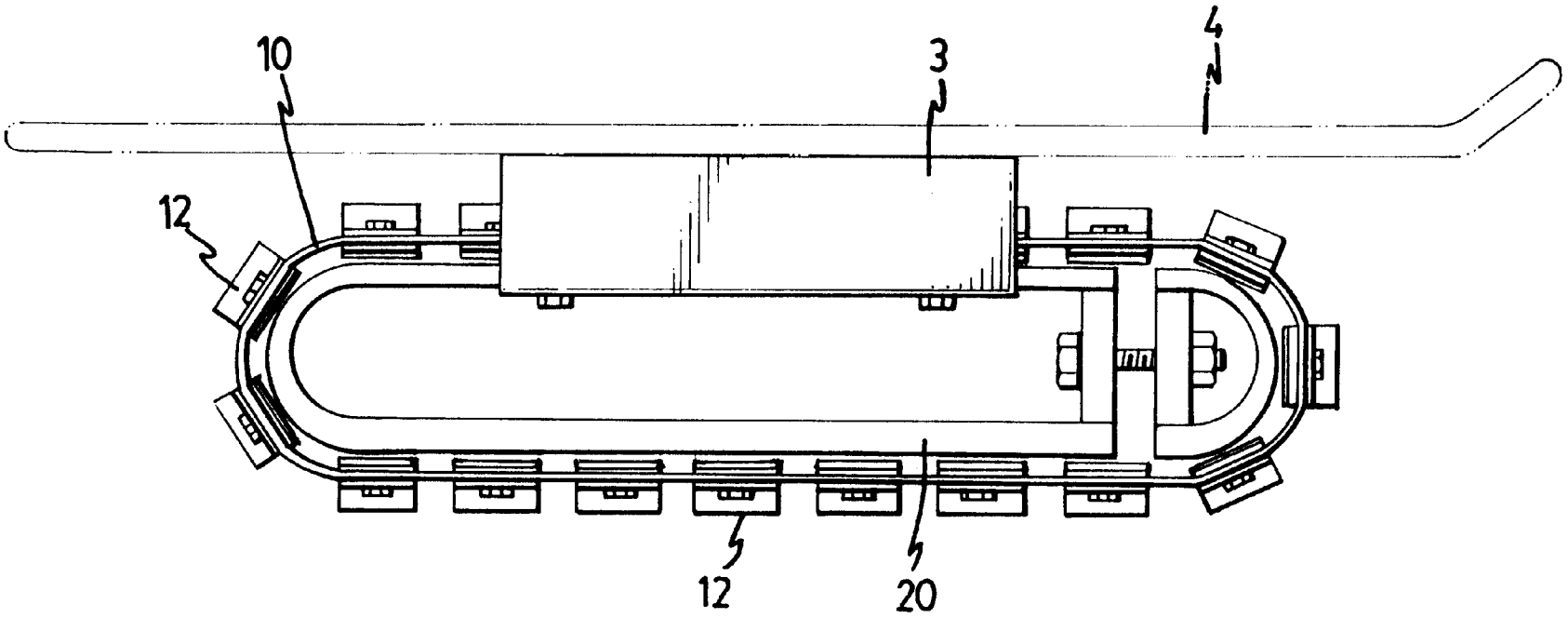
FIGS. 4 and 5 are plane views illustrating the operation of the skate device.
Figure 5:
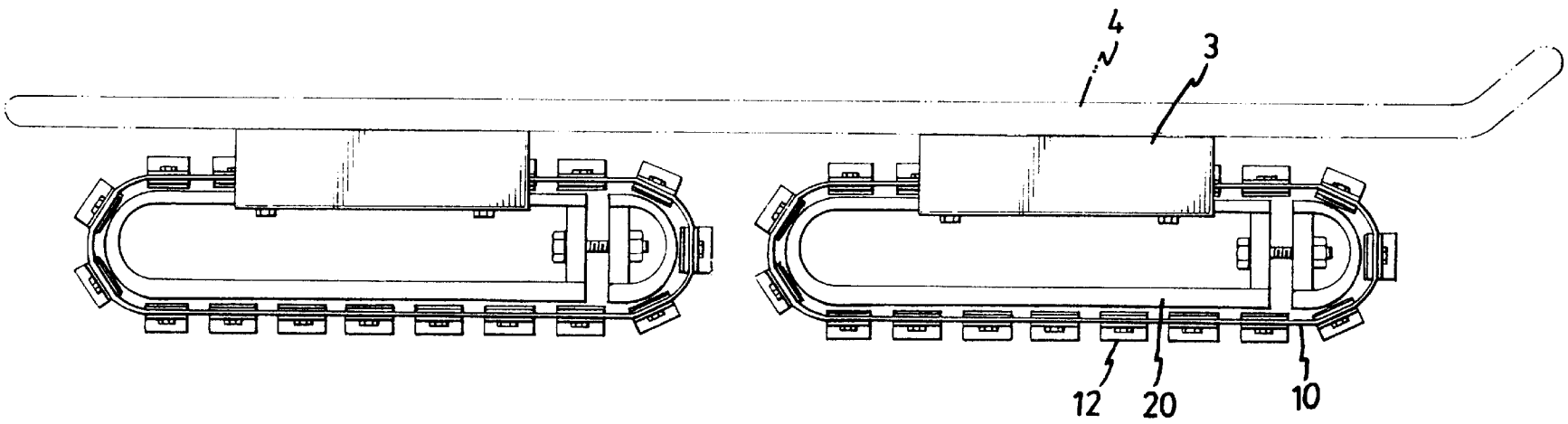

Referring to the drawings, and initially to FIGS. 1 and 2, a skate device in accordance with the present invention comprises a frame 20 including a substantially elliptic or "O" shape having a flat upper portion and a flat bottom portion and two curved end portions. Alternatively, the frame 20 may also include a circular cross section. The frame 20 includes two frame members 201, 202 separated from each other by a gap 200 and coupled together by a bolt 203 which may separate the two members 201, 202 from each other and may move the two members 201, 202 toward each other. The frame 20 includes a cushioning member 22 engaged on the outer peripheral surface of the frame 20 and includes a magnetic device 21 engaged on and engaged around the cushioning member 22. The magnetic device 21 may include and may be formed by a number of magnetic segments 21 (FIG. 3). Alternatively, the magnetic device 21 may also include an "O" shaped single-piece and integral structure. The frame 20 includes a pair of walls 205, 206 extended radially outward for forming an annular chamber 204. The walls 205, 206 each includes a magnetic device 21 engaged thereon and facing toward each other. A number of permeance members 210 are provided and engaged between the magnetic segments 21 and the frame 20 and the walls 205, 206 for confining the magnetic current and/or magnetic field within the frame 20. A housing 3 is secured to the frame 20 for supporting a shoe 4 (FIG. 1) or a skate board 4 (FIGS. 4, 5). Two or more housings 3 of the skate devices may also be secured to a skate board 4 (FIG. 5). The housing 3 and the frame 20 or the frames 20 may also be formed as an integral member by such as molding process.

A flexible and endless belt 10 is engaged around the frame 20 for moving around the frame 20. A number of casings 13 and a number of pads 12 are secured to the belt 10 by adhesive materials or by fasteners 14 and are spaced from each other for moving around the frame 20 and for forming a wheel device for the skate device. As shown in the bottom of FIG. 2, the casings 13 each includes a bracket 131 provided in the middle portion and each includes two brackets 132, 133 provided in the side portions. The brackets 131, 132, 133 each includes a permeance member 110 and a magnetic member 11 for acting with the magnetic segments 21 and for spacing the belt 10 from the frame 20. The casings 13 are received and confined within the annular chamber 204 of the frame 20. The two members 201, 202 of the frame 20 may be adjusted toward or away from each other by the bolt 203 for fitting belt 10 of different size. The walls 205, 206 of the frame 20 may retain the belt 10 and the casings 13 in the annular chamber 204 of the frame 20.

In operation, the casings 13 and the belt 10 are spaced from the magnetic segments 21 and the frame 20 such that minimal friction exists between the frame 20 and the belt 10 and such that the belt 10 may be easily and smoothly moved around the frame 20 and such that the skate device may be operated on soft and uneven surfaces. As shown in FIG. 3, when the pads 12 or the wheel device for the skate device move over bulge or swelling portion of the ground, and when the magnetic members 11 or the casings 13 strike onto the magnetic segments 21, the cushioning member 22 form an excellent shock absorbing member for absorbing vibrations and shocks that may be transmitted to the frame 20 and the housing 3, such that the user may feel comfortable.

Accordingly, the skate device in accordance with the present invention includes a magnetic support for allowing the skates to be operated on soft and uneven surfaces .

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A skate device comprising:

a frame including an outer peripheral portion, a first magnetic member engaged on said outer peripheral portion of said frame, a flexible belt engaged around said frame, and a plurality of second magnetic members secured in said belt for acting with said first magnetic member and for spacing said belt from said frame and for allowing said belt to move around said with frame minimal friction, wherein said frame includes a pair of walls extended radially outward for forming an annular chamber and for receiving said belt, said walls each includes a third magnetic member, said skate device includes a plurality of casings secured to said belt and spaced from each other, said casings each includes a middle bracket for securing said second magnetic members and each includes two side brackets and each includes fourth magnetic members engaged in said side brackets for acting with said third magnetic members and for retaining said belt in said annular chamber of said frame.

2. The skate device according to claim 1, wherein said frame includes a flat upper portion and a flat bottom portion and two curved end portions.

3. The skate device according to claim 1, wherein said frame includes two frame members separated from each other, and a bolt coupled between said two frame members for coupling said frame members together and for adjusting said two frame members away from and toward each other.

4. The skate device according to claim 1, wherein said frame includes a cushioning member engaged between said first magnetic member and said frame for absorbing shocks and vibrations transmitted to said frame.

5. The skate device according to claim 1, wherein said first magnetic member includes a plurality of magnetic segments.

6. The skate device according to claim 1, wherein said frame includes a first permeance member engaged between said frame and said first magnetic member, and includes a second permeance member engaged between said belt and said second magnetic member, and includes a third permeance member engaged between said walls of said frame and said third magnetic member, and includes a fourth permeance member engaged between said side brackets of said casing and said fourth magnetic member for confining magnetic current and magnetic field within said frame.

7. The skate device according to claim 1, wherein said belt includes an outer peripheral portion and includes a plurality of pads secured to said outer peripheral portion of said belt for allowing said pads to move around said frame and for allowing said pads to form a wheel device for said skate device.

* * * * *